United States Patent [19]

Kothmann

[11] Patent Number: 5,046,892

[45] Date of Patent: Sep. 10, 1991

[54] APERTURED PIPE SEGMENT

[76] Inventor: Antonius B. Kothmann, 4 Haarhof St., Somerset West, 7130 Cape Province, South Africa

[21] Appl. No.: 359,398

[22] Filed: May 31, 1989

[30] Foreign Application Priority Data

Jun. 7, 1988 [ZA] South Africa ..... 88/4049

[51] Int. Cl.[5] ..... E02B 11/00

[52] U.S. Cl. ..... 405/43; 405/45; 138/103; 166/234; 166/235

[58] Field of Search ..... 210/163, 166; 405/43-49, 36, 38, 39; 138/103; 166/235, 227, 234

[56] References Cited

U.S. PATENT DOCUMENTS

| | | | |
|---|---|---|---|
| 1,821,659 | 9/1931 | McEvoy | 166/234 |
| 3,502,145 | 3/1970 | DuMee et al. | 166/227 |
| 3,712,373 | 1/1973 | Bearden et al. | 166/232 |
| 3,822,744 | 7/1974 | Reijonen et al. | 166/235 |
| 4,406,326 | 9/1983 | Wagner | 166/236 X |
| 4,550,778 | 11/1985 | Sullivan et al. | 166/234 |
| 4,577,997 | 3/1986 | Lehto et al. | 405/36 X |
| 4,626,129 | 12/1986 | Kothmann et al. | 405/43 |
| 4,756,339 | 7/1988 | Buluschek | 138/103 X |

FOREIGN PATENT DOCUMENTS

| | | | |
|---|---|---|---|
| 1058416 | 5/1959 | Fed. Rep. of Germany | 166/227 |
| 1235239 | 3/1965 | Fed. Rep. of Germany | 166/227 |
| 834624 | 11/1938 | France | 166/235 |
| 1148117 | 3/1956 | France . | |
| 1180983 | 6/1959 | France | 166/235 |
| 95504 | 4/1960 | Netherlands | 166/227 |
| 1168658 | 7/1985 | U.S.S.R. | 405/43 |

OTHER PUBLICATIONS

Houston brochure entitled "Water Well Screens".

Preussag brochure entitled "SBF Casing and Screens for Water Wells-Rigid PVC".

*Primary Examiner*—Dennis L. Taylor

*Assistant Examiner*—Arlen L. Olsen

*Attorney, Agent, or Firm*—Ladas & Parry

[57] ABSTRACT

An apertured pipe segment is disclosed which is of injection moulded plastics construction and can be used to form a well screen or sub-soil drainage pipe. Each aperture comprises a longitudinally extending inner slot which extends from a slot mouth inwardly and is defined by inwardly diverging slot walls, and an outer slot which extends from the outside of the pipe segment inwardly to the slot mouth. The smallest width of the outer slot is greater than the width of the slot mouth. The inner slot is open longitudinally to one end of the pipe segment and the outer slot is open longitudinally to the other end of the pipe segment. The pipe segments can thus be made by an inexpensive two-part mould not requiring collapsible cores.

4 Claims, 1 Drawing Sheet

APERTURED PIPE SEGMENT

FIELD OF THE INVENTION

This invention relates to an apertured pipe segment having apertures in the wall thereof for the ingress of water into the pipe segment. Such pipe segments can be used to form well screens or sub-soil drainage pipes, which permit water to flow through the apertures but exclude soil particles which are greater than the apertures.

BACKGROUND OF THE INVENTION

Well screens are available that consist of a helically coiled stainless steel wire of trapezoidal cross section, welded to an inner cage of axially extending stainless steel wires. Well screens of this type are referred to as wedge wire screens. There is a narrow gap between successive coils of the coiled wire, forming a helically extending slot through which water can, in use, enter from a surrounding aquifer into the well screen. As a result of the trapezoidal cross-section of the coiled wire, the slot widens from the outside of the well screen inwardly. The advantages of tapered slots, i.e. slots that widen from the outside of the screen inwardly, are well known. Wedge wire screens are, however, very expensive. Furthermore, although stainless steel does not corrode easily, corrosion cannot be eliminated entirely. Corrosion causes encrustation, which has the effect of reducing the slot area. Corrosion also weakens the structure of the well screen.

Well screens that consist of extruded plastic pipes are also available. In this type of well screen slots for the ingress of water are formed by producing cuts in the wall of the pipe. Cut slots have parallel slot walls so that well screens of this type do not have the advantages offered by well screens with tapered slots. A major disadvantage of slots having parallel slot walls is that they are far more prone to clogging than is the case with tapered slots. Moreover, the cutting process tends to produce slots with rough slot walls, and this aggravates the clogging problem in that soil particles more readily become lodged in slots which have rough slot walls. In one form of extruded well screen the slots extend across the pipe, i.e. at right angles to the longitudinal direction of the pipe. Slots of this configuration significantly reduce the ability of the pipe to withstand axial loads.

In applicant's U.S. Pat. No. 4,626,129 there is disclosed an apertured pipe segment which has tapered slots, the configuration of the pipe segment being such that it can easily be made from a plastics material by means of an injection moulding process. The pipe segments are formed with a socket at one end, into which the other end of an adjacent segment is a close fit. This requires the pipe segment to have an external collar at the socket end. If a number of such pipe segments are connected end-to-end, the assembly can be used as a well screen. It has been found, however, that the collars on such an assembly lead to snagging when the assembly is lowered into or extracted from a borehole.

It is an object of the present invention to provide an apertured pipe segment which has tapered slots and can easily be made by means of an injection moulding process, yet does not have an external collar to cause snagging in a borehole. It is a further object of the invention to provide an apertured pipe segment with slots which are better able to prevent soil particles from entering through the slots into the pipe segment, yet permit water to enter. It is still a further object of the invention to provide a well screen which is sufficiently strong to withstand the forces encountered at the bottom of a borehole. Further objects of the invention will become apparent from the description hereinafter of the preferred embodiments.

According to the invention there is provided an apertured pipe segment having a pipe wall and apertures in the pipe wall for the ingress of water into the pipe segment, the apertures each being formed by a recess in the outside of the pipe wall and an inner slot defined by opposed slot walls which diverge from the bottom of the recess inwardly to the inside of the pipe segment, the recess being in flow communication with the inner slot via a slot mouth at the bottom of the recess, which slot mouth is narrower than the smallest transverse dimension of the recess.

The inner slots may extend longitudinally of the pipe segment. In other words, where, as would be convenient, the pipe segment is of round cross section, the inner slots would extend in the axial direction.

Each of the inner slots may, across its entire width and depth, be open longitudinally. If the pipe segment is made by injection moulding, this configuration of the inner slots will permit them to be formed by fins on a mould part which can be withdrawn axially during demoulding.

Said recesses may be in the form of slots (referred to herein as the outer slots), defined by opposed slot walls, the outer slots being aligned with the inner slots.

The slot walls of each of the outer slots may diverge from the outside of the pipe segment inwardly.

Each of the outer slots may, across its entire width and depth, be open longitudinally.

The inner slots may be open longitudinally in the direction of one end of the pipe segment, and the outer slots may be open longitudinally in the direction of the other end of the pipe segment.

The pipe segment may have a socket formation at said one end and a spigot formation at said other end, the spigot formation being complementary to the socket formation, so that a series of such pipe segments can be interconnected end-to-end with the spigot formation of one pipe segment entering into the socket formation of the next.

Further according to the invention there is provided an apertured pipe which comprises a series of pipe segments each having a socket formation at one end thereof and a complementary spigot formation at the other end thereof and the pipe segments being connected together end-to-end with the spigot formation of one pipe segment being accommodated in the socket formation of the adjacent pipe segment, each pipe segment having a pipe wall and apertures in the pipe wall for the ingress of water into the pipe, each aperture being formed by an outer slot which extends from the spigot formation in the direction of the socket formation and an inner slot which extends from the socket formation in the direction of the spigot formation, the outer slot being in flow communication with the inner slot via a slot mouth at the bottom of the outer slot, which slot mouth is narrower than the smallest transverse dimension of the outer slot, and the inner slot being defined by opposed slot walls which diverge from the slot mouth inwardly to the inside of the pipe segment.

The invention will now be described in more detail, by way of example, with reference to the accompanying drawings.

DETAILED DESCRIPTION OF PREFERRED EMBODIMENTS

Figure 1:
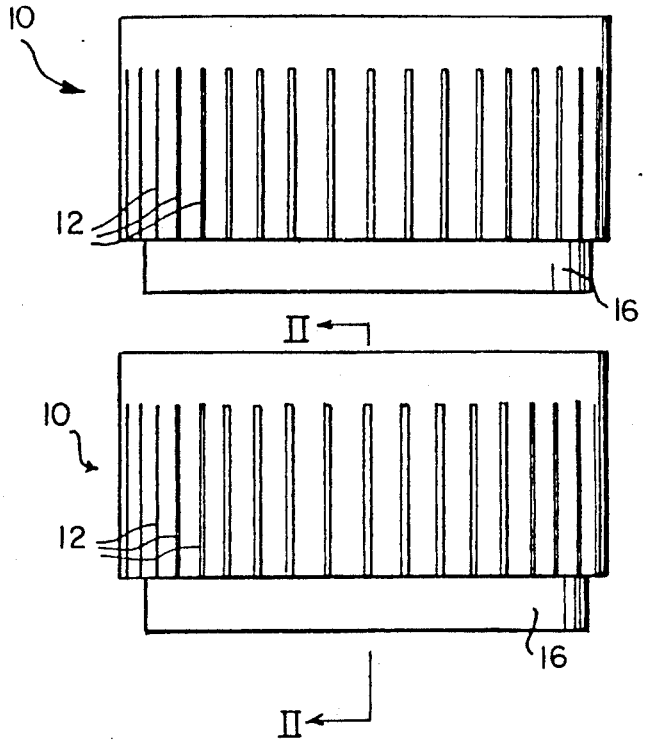
FIG. 1 is a side view of two apertured pipe segments in accordance with the invention.
Figure 3:
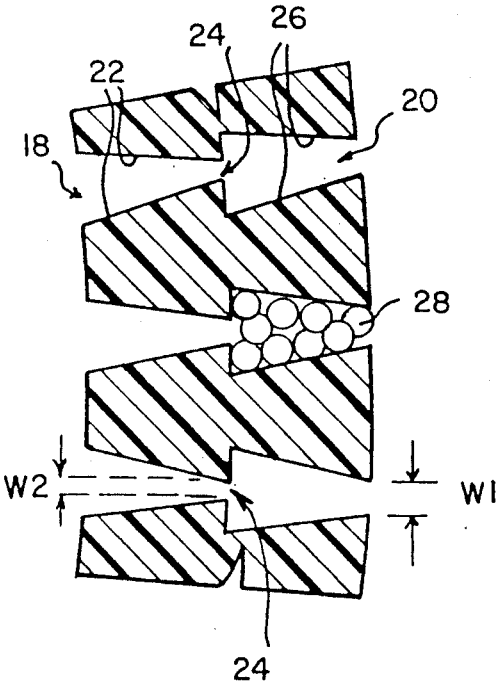
FIG. 3 is a detail cross section on line III—III in FIG. 2.
Figure 2:
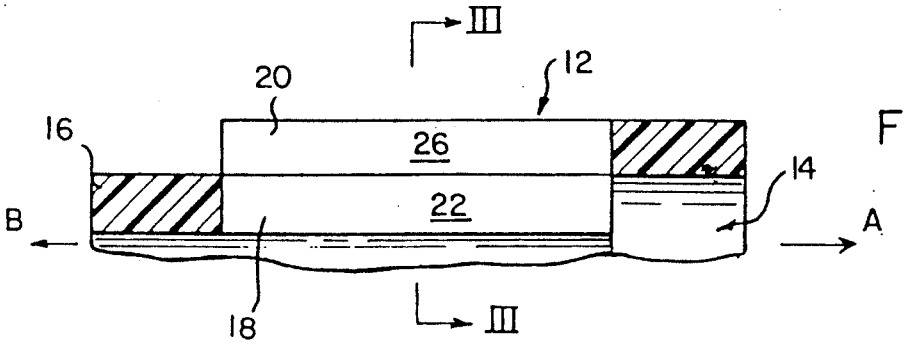
FIG. 2 is a detail longitudinal section through the wall of one of the pipe segments, on line II—II in FIG. 1.

Referring first to FIGS. 1 to 3, reference numeral 10 generally indicates an apertured pipe segment which is round in cross-section and has a number of circumferentially spaced, longitudinally extending, slot-like apertures 12 in the wall thereof, for the ingress of water into the pipe segment. Each pipe segment has a socket formation 14 at one end thereof and a complementary spigot formation 16 at the other end thereof. The spigot and socket formations enable a series of such pipe segments to be interconnected end-to-end to form, for example, a well screen which is several times the length of the individual segments.

As can best be seen in FIG. 3, each of the apertures 12 comprises an inner slot 18 and an outer slot 20. The inner slot 18 is defined by slot walls 22 which diverge from a mouth 24 to the inside of the pipe segment. In other words, the inner slot 18 becomes wider from the outside of the pipe segment inwardly. The outer slot 20 is defined by slot walls 26 which also diverge from the outside of the pipe segment inwardly, the outer slot being in flow communication with the inner slot via the mouth 24. The smallest transverse dimension of the outer slot 20, i.e. its width W1 at the outside of the pipe segment, is greater than the width W2 of the mouth 24.

As can best be seen in FIG. 2, the inner slots 18 open longitudinally into the socket formation 14, and the outer slots 20 open longitudinally in the direction of the spigot end of the pipe segment. The inner slots 18 are open longitudinally across their entire width and depth, so that they can be formed by external fins on a mould part which, during demoulding, is withdrawn longitudinally, i.e. in the direction of arrow A. Likewise, the outer slots 20 are open longitudinally across their entire width and depth in the direction of the spigot end of the pipe segment. This will enable the outer slots 20 to be formed by internal fins on a mould part which, during demoulding, is withdrawn longitudinally in the direction of arrow B.

The pipe segments 10 can thus be made in a mould which has an inner mould part or core with a number of circumferentially spaced, longitudinally extending external fins which taper down radially outwardly, and an outer mould part which has a number of radially inwardly directed fins which diverge radially inwardly. When the mould parts are closed for the moulding operation, the radially outer faces of the fins on the inner mould part will touch the radially inwardly facing faces of the fins in the outer mould part. Because the slot portions 18 and 20 are each open at one end in the longitudinal direction, an inexpensive two-part mould can be used. No collapsible cores are required.

The pipe segments 10 are conveniently made of a plastics material, by injection moulding. Because the apertures 12 are formed by moulding (as opposed to cutting or other forms of machining) it is possible to form the walls 22 and 26 as smooth, polished surfaces. This makes it less likely for the slots to become clogged.

In use, a well screen made up of a number of the pipe segments 10 will be installed at the bottom of a borehole. Water will be able to flow from the outside of the well screen to the inside thereof, through the apertures 12. The inner slots 18 will have the effect of excluding soil particles which are greater than the width W2 of the mouth 24. Soil particles of up to the size W1, however, will be able to enter into the outer slots 20. The effect of this will be that soil particles 28 which are greater than the width W2 but smaller than the width W1 will enter into the outer slots 20 and become trapped there. Greater particles will be excluded by the entrance width of the outer slots. Smaller particles will be able to migrate through the inner slots 18 into the well screen, from where they can be pumped out. This will only take place initially, until all the smaller particles in the vicinity of the apertures have been washed away. The trapped, greater particles 28 will have a filtering effect on water entering the well screen. They will also have a strengthening effect in that they will resist inward collapsing of the pipe segment due to external pressure.

The length of the socket 14 is approximately equal to the length of the spigot 16. Thus, when the pipe segments are interconnected as aforesaid, the transition from one segment to the next will be substantially uninterrupted by any collar or groove. This construction will facilitate lowering the assembly of pipe segments down a borehole or extracting them again.

Figure 4:
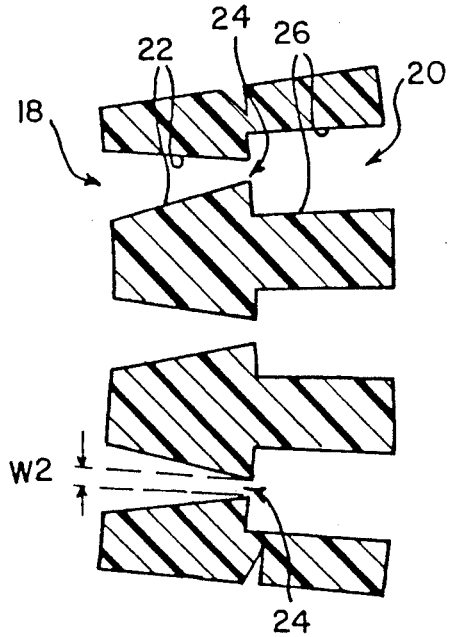
FIG. 4 is a cross-section similar to that of FIG. 3, but showing another construction in accordance with the invention.

FIG. 4 shows a construction which is similar to that shown in FIG. 3, the same reference numerals being used to designate the same parts. The construction differs from the FIG. 3 constructions in that the walls 26 of each outer slot 20 are parallel to one another instead of diverging from the outside of the pipe segment inwardly.

If desired, the socket 14 and the spigot 16 may each be provided with a slight taper (about 1° to 2°). This will facilitate joining of the pipe segments by means of an adhesive, in that it will prevent the adhesive from being wiped off the opposed cylindrical surfaces as the pipe segments are slid together during assembly.

Pipe segments which do not have apertures in them can easily be produced by replacing finned inserts of the mould, that produce the slots 18 and 20, by unfinned inserts. Apart from the absence of slots, these un-apertured pipe segments will be identical to the apertured pipe segments and can be used to form a casing for the upper part of the borehole. The un-apertured pipe segments can be joined to one another and to the apertured pipe segments in exactly the same manner that the apertured pipe segments are joined to one another. Because of the matching sizes and materials, the difficulties that are often experienced in joining a casing to a well screen are thus avoided.

I claim:

1. An apertured pipe segment having a pipe wall and apertures in the pipe wall for the ingress of water into the pipe segment, the apertures each being formed by a longitudinally extending outer slot on an outside portion of the pipe wall and a longitudinal extending inner slot defined by opposed slot walls which diverge from the bottom of the outer slot inwardly on an inside portion of the pipe segment, the outer slot being in flow communication with the inner slot via a slot mouth at the bottom of the outer slot, which slot mouth is narrower than the smallest transverse dimension of the outer slot, each inner slot extending, across its entire width and depth, longitudinally to the extremity of the inside portion at one end of the pipe segment, and each outer slot extending, across its entire width and depth, longitudinally to the extremity of the outside portion at the other end of the pipe segment.

2. An apertured pipe segment according to claim 1, wherein the slot walls of each of the outer slots diverge from the outside of the pipe segment inwardly.

3. An apertured pipe segment according to claim 1, wherein the pipe segment has a socket formation at said one end and a complementary spigot formation extending to said other end from an external shoulder set back from said other end, so that a series of such pipe segments can be interconnected end-to-end with the spigot formation of one pipe segment entering into the socket formation of the adjacent pipe segment, each outer slot extending from the external shoulder in the direction of the socket formation, and each inner slot extending from the socket formation in the direction of the spigot formation.

4. An apertured pipe which comprises a series of pipe segments each having a socket formation at one end thereof and a complementary spigot formation extending to the other end thereof from an external shoulder set back from said other end, and the pipe segments being connected together end-to-end with the spigot formation of one pipe segment being accommodated in the socket formation of the adjacent pipe segment, each pipe segment having a pipe wall and apertures in the pipe wall for the ingress of water into the pipe, each aperture being formed by an outer slot which extends from the external shoulder to an open end at the socket formation and an inner slot which extends from the socket formation to an open end at the spigot formation, the outer slot being in flow communication with the inner slot via a slot mouth at the bottom of the outer slot, which slot mouth is narrower than the smallest transverse dimension of the outer slot, and the inner slot being defined by opposed slot walls which diverge from the slot mouth inwardly to the inside of the pipe segment.

* * * * *